US010634020B2

(12) United States Patent
Hirota et al.

(10) Patent No.: US 10,634,020 B2
(45) Date of Patent: Apr. 28, 2020

(54) INTERNAL COMBUSTION ENGINE

(71) Applicant: TOYOTA JIDOSHA KABUSHIKI KAISHA, Toyota-shi (JP)

(72) Inventors: Satoshi Hirota, Toyota (JP); Yuya Horii, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/259,313

(22) Filed: Jan. 28, 2019

(65) Prior Publication Data

US 2019/0234257 A1 Aug. 1, 2019

(30) Foreign Application Priority Data

Feb. 1, 2018 (JP) ..... 2018-016502

(51) Int. Cl.

| | |
|---|---|
| ***F01M 1/04*** | (2006.01) |
| ***F01M 11/02*** | (2006.01) |
| ***F01P 3/02*** | (2006.01) |
| ***F02F 1/14*** | (2006.01) |
| *F01M 13/00* | (2006.01) |

(52) U.S. Cl.

CPC ..... *F01M 1/04* (2013.01); *F01M 11/02* (2013.01); *F01P 3/02* (2013.01); *F02F 1/14* (2013.01); *F01M 2011/023* (2013.01); *F01M 2013/0038* (2013.01)

(58) Field of Classification Search

CPC .... F01M 1/04; F01M 11/02; F01M 2011/022; F01M 2011/023; F01M 2013/0038; F01P 3/02; F02F 1/14

See application file for complete search history.

(56) References Cited

U.S. PATENT DOCUMENTS

| | | | | |
|---|---|---|---|---|
| 2005/0092267 | A1* | 5/2005 | Nonaka | F01M 13/0416 123/41.86 |
| 2013/0074815 | A1* | 3/2013 | Yuge | F01M 13/023 123/574 |
| 2017/0175601 | A1* | 6/2017 | Usa | F01M 13/04 |
| 2019/0234259 | A1 | 8/2019 | Komada et al. | |

FOREIGN PATENT DOCUMENTS

| | | |
|---|---|---|
| JP | 2011-247101 | 12/2011 |
| JP | 2014-105579 | 6/2014 |
| JP | 2019-132235 A | 8/2019 |

* cited by examiner

*Primary Examiner* — Jacob M Amick

(74) *Attorney, Agent, or Firm* — Oblon, McClelland, Maier & Neustadt, L.L.P.

(57) ABSTRACT

First and second oil chambers arranged in a cylinder arrangement direction with a partition wall interposed therebetween are formed in a cylinder block. A cylinder head includes first and second communication passages respectively connected to the first and second oil chambers. The communication passages are configured so that a resistance generated when gas is caused to flow from the first oil chamber to a space above the head through the first communication passage is smaller than a resistance generated when gas is caused to flow from the second oil chamber to the space above the head through the second communication passage. The cylinder block includes an oil passage connected to both the oil chambers. The partition wall includes a connection hole for allowing the first and second oil chambers to communicate with each other.

8 Claims, 3 Drawing Sheets

INTERNAL COMBUSTION ENGINE

BACKGROUND

The present disclosure relates to an internal combustion engine configured so that oil returns from a space above the cylinder head to the oil pan through the inside of the cylinder head and the inside of the cylinder block.

A cylinder block of an internal combustion engine described in Japanese Laid-Open Patent Publication No. 2014-105579 includes two recesses arranged to be adjacent to each other in a cylinder arrangement direction. The cylinder arrangement direction is a direction in which the cylinders are arranged in the cylinder block. A first oil chamber and a second oil chamber are formed in the cylinder block by closing the recesses with the cylinder head. Into the first and second oil chambers, oil in a space above the head existing above the cylinder head flows through first and second communication passages provided in the cylinder head.

An oil passage connected to both the first oil chamber and the second oil chamber is provided in the cylinder block. The oil accumulated in each oil chamber is returned to the oil pan through the oil passage.

When the amount of oil flowing into the space above the head increases due to increase in the engine rotation speed or the engine load factor, and the like, the amount of oil flowing into the oil chamber through the first and second communication passages increases and the pressure inside the oil chamber increases. Furthermore, when the engine rotation speed or the engine load factor increases, the pressure in the crankcase of the internal combustion engine and in the oil pan may increase. In this case, the blow-by gas in the crankcase flows backward through the oil passage and flows into each oil chamber. As a result, not only oil but also gas such as blow-by gas accumulates in each oil chamber.

Furthermore, the width in the cylinder arrangement direction of the first oil chamber and the width in the cylinder arrangement direction of the second oil chamber may be different from each other depending on the number of cylinders provided in the cylinder block. In this case, the number of communication passages connected to the oil chamber of which the width in the cylinder arrangement direction is narrower may become smaller than the number of communication passages connected to the oil chamber of which the width in the cylinder arrangement direction is wider.

For example, assume that the number of first communication passages connected to the first oil chamber is plural while the number of second communication passages connected to the second oil chamber is one. In this case, the resistance generated when causing gas to flow from the second oil chamber to the space above the head through the second communication passage is larger than the resistance generated when causing gas to flow from the first oil chamber to the space above the head through the first communication passage. As a result, compared with the discharge performance of the gas from the first oil chamber to the space above the head through each first communication passage, the discharge performance of the gas from the second oil chamber to the space above the head through the second communication passage becomes low. That is, gas tends to easily accumulate in the second oil chamber. In a state where the gas is accumulated in the second oil chamber, the oil is less likely to flow from the space above the head to the second oil chamber through the second communication passage. As a result, the amount of oil returning into the oil pan through the second oil chamber decreases, and the retained amount of oil in the oil pan decreases.

Therefore, there is room for improvement in suppressing hindrance of the circulation of the oil through the second oil chamber by the gas flowing into the second oil chamber.

SUMMARY

In accordance with one aspect of the present disclosure, an internal combustion engine that includes a cylinder block and a cylinder head is provided. The cylinder block includes a plurality of cylinders arranged in a cylinder arrangement direction, a first recess and a second recess arranged in the cylinder arrangement direction, and a partition wall located between the first and second recesses. The cylinder head is attached to the cylinder block. The cylinder head closes the first recess and the second recess to form a first oil chamber and a second oil chamber arranged in the cylinder arrangement direction with the partition wall interposed in between in the cylinder block. The cylinder head includes a first communication passage opened in an upper surface of the cylinder head and connected to the first oil chamber, and a second communication passage opened in the upper surface of the cylinder head and connected to the second oil chamber. A space above a head exists above the cylinder head. The first and second communication passages are configured so that a resistance generated when gas is caused to flow from the first oil chamber to the space above the head through the first communication passage is smaller than a resistance generated when gas is caused to flow from the second oil chamber to the space above the head through the second communication passage. The cylinder block includes an oil passage connected to both the first oil chamber and the second oil chamber and configured to return oil accumulated in the oil chambers to an oil pan. The partition wall includes a connection hole allowing the first oil chamber and the second oil chamber to communicate with each other.

According to the configuration described above, the discharge performance of the gas from the first oil chamber to the space above the head through the first communication passage is higher than the discharge performance of the gas from the second oil chamber to the space above the head through the second communication passage. Therefore, the gas that has flowed into the first oil chamber is easily discharged to the outside of the first oil chamber through the first communication passage. Thus, the gas is less likely to accumulate in the first oil chamber, and hence the inflow of the oil from the space above the head to the first oil chamber through the first communication passage is less likely to be inhibited by the gas accumulated in the first oil chamber. As a result, the circulation of the oil through the first oil chamber can be properly carried out.

On the other hand, gas may also flow into the second oil chamber from the oil pan through the oil passage. According to the configuration described above, the gas that has flowed into the second oil chamber can be caused to flow out to the first oil chamber through a connection hole. Therefore, even if the discharge performance of the gas from the second oil chamber to the space above the head through the second communication passage is low, the oil in the space above the head is prevented from being less likely to flow into the second oil chamber through the second communication passage because the gas is less likely to continue to accumulate in the second oil chamber. Then, the oil that has flowed into the second oil chamber is returned to the oil pan through the oil passage.

Therefore, according to the configuration described above, the circulation of the oil through the first oil chamber can be properly carried out and the circulation of the oil through the second oil chamber can be properly carried out, and furthermore, the amount of oil retained in the oil pan will not decrease.

The number of the first communication passages may be larger than the number of the second communication passages. Thus, the resistance generated when causing gas to flow from the first oil chamber to the space above the head through the first communication passage can be made smaller than a resistance generated when causing gas to flow from the second oil chamber to the space above the head through the second communication passage.

The gas that has flowed into the second oil chamber tends to easily accumulate in an upper region of the second oil chamber. Thus, the connection hole may be arranged at a portion above the middle in a vertical direction of the partition wall. According to such configuration, the gas accumulated in the second oil chamber can easily flow out to the first oil chamber through the connection hole.

The gas that has flowed into the second oil chamber is more easily flowed out into the first oil chamber as the passage cross-sectional area of the connection hole is increased. However, due to the restriction in the arrangement of the oil chamber in the cylinder block, the width of each oil chamber in the direction orthogonal to both the vertical direction and the cylinder arrangement direction is narrow, and hence the passage cross-sectional area of the connection hole becomes difficult to increase. Thus, the connection hole is one of a plurality of connection holes arranged in the vertical direction.

According to the configuration described above, the gas that has flowed into the second oil chamber can be easily caused to flow out to the first oil chamber by aligning a plurality of connection holes in the vertical direction.

The gas easily accumulates near a partition wall in the second oil chamber because the gas that has flowed into the second oil chamber flows out to the first oil chamber through the connection hole. Thus, the second communication passage may be connected to the second oil chamber on an opposite side of a center of the second oil chamber from the partition wall in the cylinder arrangement direction. According to this configuration, the flow of oil from the space above the head to the second oil chamber through the second communication passage is less likely to be obstructed by the gas accumulated in the second oil chamber as a connecting portion of the second communication passage with respect to the second oil chamber is spaced apart from the partition wall.

The connection hole may be extended in a direction inclined with respect to the cylinder arrangement direction.

The volume of the second oil chamber may be smaller than the volume of the first oil chamber.

When the number of cylinders is an odd number of three or more, and the partition wall may be arranged between center axes of two of the cylinders adjacent to each other in the cylinder arrangement direction.

Other aspects and advantages of the present disclosure will become apparent from the following description, taken in conjunction with the accompanying drawings, illustrating exemplary embodiments.

BRIEF DESCRIPTION OF THE DRAWINGS

The disclosure may be understood by reference to the following description together with the accompanying drawings.

DETAILED DESCRIPTION

An internal combustion engine 10 according to an embodiment will now be described with reference to FIGS. 1 to 5.

Figure 1:
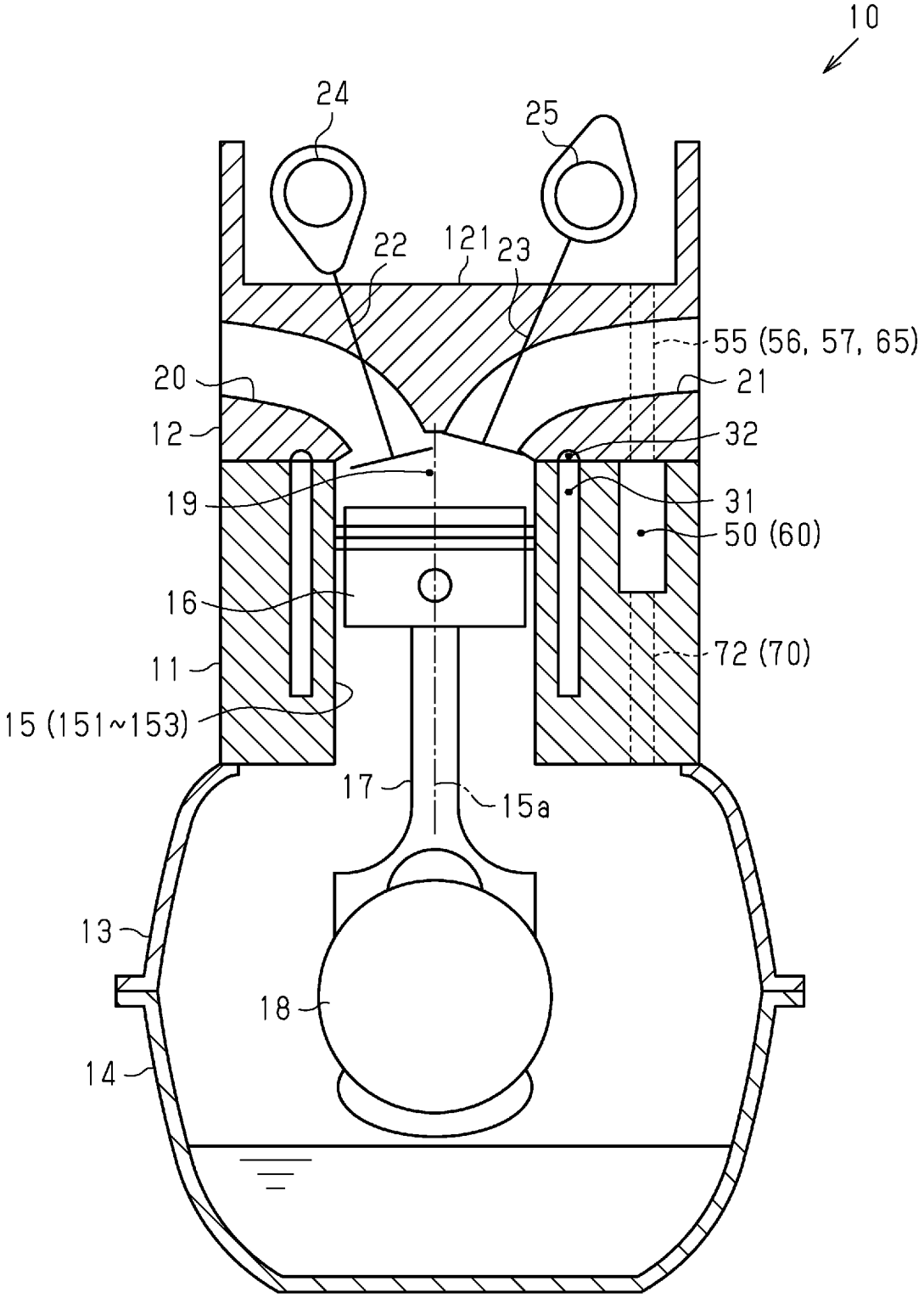
FIG. 1 is a cross-sectional view schematically showing an internal combustion engine according to one embodiment.

As shown in FIG. 1, the internal combustion engine 10 mounted on a vehicle includes a cylinder block 11 and a cylinder head 12 attached to an upper portion of the cylinder block 11. The internal combustion engine 10 also includes a crankcase 13 attached to a lower portion of the cylinder block 11 and an oil pan 14 attached to a lower portion of the crankcase 13. The oil retained in the oil pan 14 is pumped up by an oil pump and is supplied to each oil requiring portion in the internal combustion engine 10.

Figure 2:
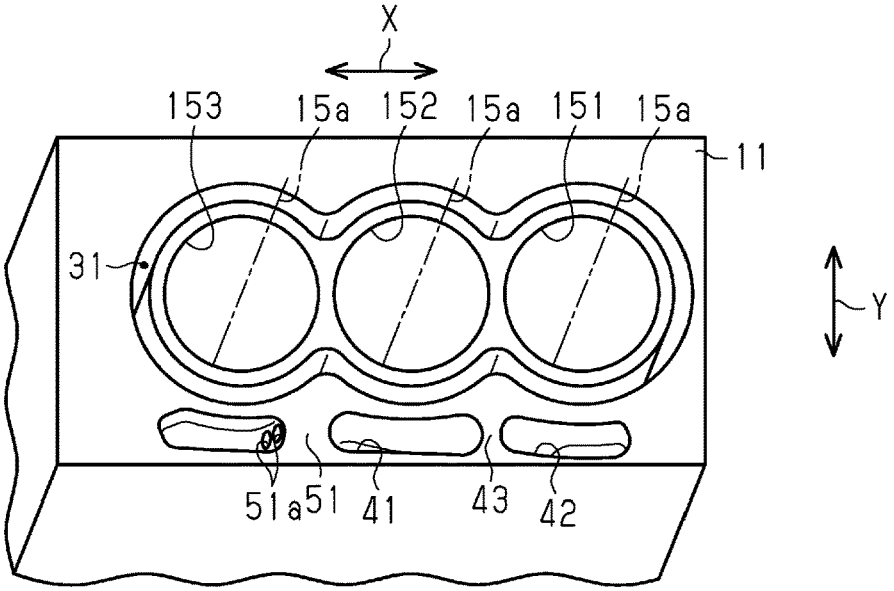
FIG. 2 is a perspective view schematically showing a part of a cylinder block of the internal combustion engine of FIG. 1.

As shown in FIGS. 1 and 2, a plurality (three in the present embodiment) of cylinders 15 (151, 152, 153) are provided in the cylinder block 11. The direction in which the plurality of cylinders 15 are arranged in the cylinder block 11 is referred to as cylinder arrangement direction X. Among the plurality of cylinders 15, a cylinder located at one end (right end in FIG. 2) in the cylinder arrangement direction X is the first cylinder 151, a cylinder located at the other end (left end in FIG. 2) in the cylinder arrangement direction X is the third cylinder 153, and a cylinder located between the first cylinder 151 and the third cylinder 153 is the second cylinder 152. A piston 16 that reciprocates in the vertical direction in FIG. 1 is provided in each of the cylinders 151 to 153. These pistons 16 are coupled to the crankshaft 18 by way of a connecting rod 17. The crankshaft 18 is disposed in a space defined by the crankcase 13 and the oil pan 14.

A combustion chamber 19 is defined by a peripheral wall of each of the cylinders 151 to 153, each of the pistons 16, and the cylinder head 12. In each combustion chamber 19, a mixed air containing the intake air introduced into the combustion chamber 19 through a corresponding intake passage 20 and the fuel injected from a fuel injection valve is burned. The exhaust gas generated in each combustion chamber 19 by the combustion of the mixed air is discharged to a corresponding exhaust passage 21.

The opening and closing of the intake passage 20 with respect to each combustion chamber 19 is performed by an intake valve 22, and the opening and closing of the exhaust passage 21 with respect to each combustion chamber 19 is performed by an exhaust valve 23. The intake valve 22 operates in synchronization with the rotation of an intake camshaft 24. Further, the exhaust valve 23 operates in synchronization with the rotation of an exhaust camshaft 25.

Figure 3:
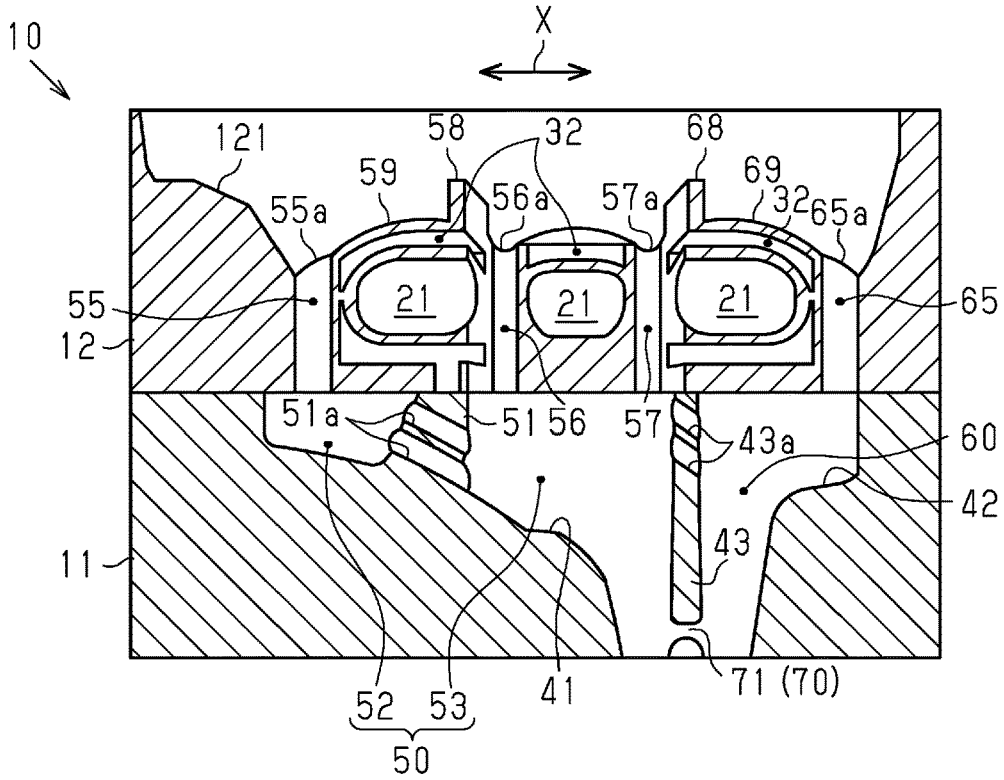
FIG. 3 is a view schematically showing a cross section of the cylinder block and a cross section of a cylinder head in the internal combustion engine of FIG. 1.

As shown in FIGS. 1 and 2, a block side cooling water passage 31 through which cooling water flows is provided in the cylinder block 11 so as to surround all the cylinders 151 to 153. As shown in FIGS. 1 and 3, a head-side cooling water passage 32 through which cooling water flows is provided in the cylinder head 12. In the present embodiment, a part of the cooling water flowing through the block side cooling water passage 31 flows into the head-side cooling water passage 32.

A direction orthogonal to both the extending direction of a central axis 15*a* of each of the cylinders 151 to 153 and the cylinder arrangement direction X is referred to as a specified direction Y. As shown in FIGS. 2 and 3, a first recess 41 and a second recess 42 arranged in the cylinder arrangement direction X are provided closer to the outer side of the cylinder block 11 than the block side cooling water passage 31 in the specified direction Y. In the cylinder arrangement direction X, the first recess 41 and the second recess 42 are adjacent to each other with a partition wall 43 interposed therebetween. The first recess 41 and the second recess 42 are opened on the upper surface of the cylinder block 11. As shown in FIG. 2, the partition wall 43 is disposed between the central axis 15*a* of the first cylinder 151 and the central axis 15*a* of the second cylinder 152 in the cylinder arrangement direction X.

As shown in FIG. 3, each recess 41, 42 (more specifically, opening of each recess 41, 42) is closed by the cylinder head 12. Thus, a first oil chamber 50 and a second oil chamber 60 adjacent to each other in the cylinder arrangement direction X are formed in the cylinder block 11. In the present embodiment, both oil chambers 50, 60 are formed so that the volume of the second oil chamber 60 is smaller than the volume of the first oil chamber 50.

Among the two ends of the first oil chamber 50 in the cylinder arrangement direction X, the end (left end in FIG. 3), which is distant from the second oil chamber 60, is located farther away from the center of the cylinder block 11 in the cylinder arrangement direction X than the central axis 15*a* of the third cylinder 153. The depth of the first oil chamber 50, which is the length in the vertical direction of the first oil chamber 50, becomes deeper as it approaches the second oil chamber 60 in the cylinder arrangement direction X. The first oil chamber 50 is partitioned into a first oil division chamber 52 and a second oil division chamber 53 by a partition wall 51 provided in the cylinder block 11. The second oil division chamber 53 is arranged closer to the second oil chamber 60 than the first oil division chamber 52. That is, the second oil division chamber 53 is disposed between the first oil division chamber 52 and the second oil chamber 60. Furthermore, the first oil division chamber 52 and the second oil division chamber 53 communicate with each other through a through-hole 51*a* provided in the partition wall 51. In the present embodiment, two through-holes 51*a* are arranged in the vertical direction. Each through-hole 51*a* is formed so as to be located downward in the cylinder arrangement direction X as it separates away from the first oil division chamber 52. That is, the extending direction of each through-hole 51*a* is inclined with respect to the cylinder arrangement direction X.

Among the two ends of the second oil chamber 60 in the cylinder arrangement direction X, the end (right end in FIG. 3), which is distant from the first oil chamber 50, is located farther away from the center of the cylinder block 11 in the cylinder arrangement direction X than the central axis 15*a* of the first cylinder 151. The depth of the second oil chamber 60, which is the length in the vertical direction of the second oil chamber 60, becomes deeper as it approaches the first oil chamber 50 in the cylinder arrangement direction X.

The cylinder block 11 includes a collecting portion 71 that connects the second oil division chamber 53 and the second oil chamber 60 below the partition wall 43. An oil flow-down passage 72 (see FIG. 1) for allowing the oil accumulated in each of the oil chambers 50, 60 to flow down toward the oil pan 14 is connected to the collecting portion 71. That is, in the present embodiment, the collecting portion 71 and the oil flow-down passage 72 are connected to both the first oil chamber 50 and the second oil chamber 60, and configure an oil passage 70 for returning the oil accumulated in each of the oil chambers 50, 60 into the oil pan 14. In the present embodiment, the oil passage 70 is connected to the second oil division chamber 53, but is not connected to the first oil division chamber 52.

In addition, the partition wall 43 is provided with a connection hole 43*a* that allows the second oil division chamber 53 and the second oil chamber 60 to communicate with each other. In the present embodiment, a plurality (two in FIG. 3) of connection holes 43*a* are arranged in the vertical direction. In addition, each of the connection holes 43*a* is arranged at a portion above the center in the vertical direction of the partition wall 43. Furthermore, the extending direction of each connection hole 43*a* is inclined with respect to the cylinder arrangement direction X. Specifically, each connection hole 43*a* is formed so as to be located downward as it approaches the second oil chamber 60.

Figure 4:
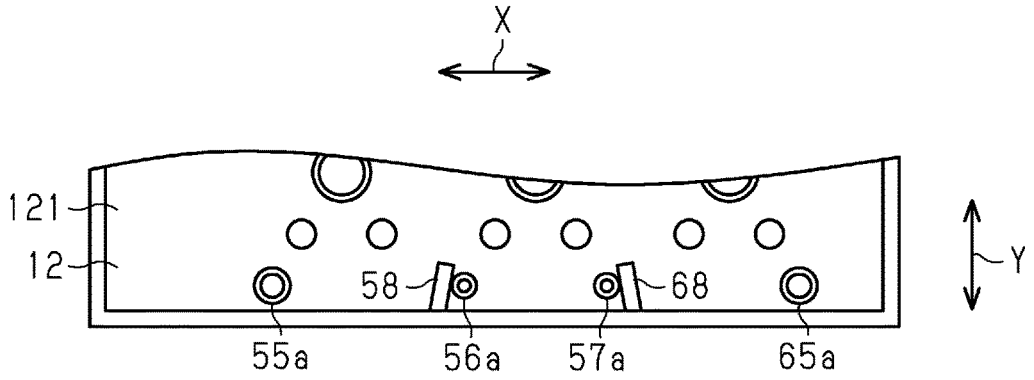
FIG. 4 is a plan view schematically showing a part of an upper surface of the cylinder head of FIG. 3.

As shown in FIGS. 3 and 4, the cylinder head 12 is provided with a plurality of (three in FIG. 3) first communication passages 55, 56, 57 opened in the upper surface 121 of the cylinder head 12 and connected to the first oil chamber 50. The first communication passages 55 to 57 extend substantially in the vertical direction. Furthermore, the first communication passages 55 to 57 are arranged in the cylinder arrangement direction X. The first communication passage 55 located on the leftmost side of the first communication passages 55 to 57 is connected to the first oil division chamber 52 but is not connected to the second oil division chamber 53. The remaining first communication passages 56, 57 are connected to the second oil division chamber 53, but are not connected to the first oil division chamber 52. The passage cross-sectional area of the first communication passage 55 is greater than the passage cross-sectional area of each of the first communication passages 56, 57. Hereinafter, the first communication passage 55 having a relatively large passage cross-sectional area is referred to as a first large communication passage 55, and the first communication passages 56 and 57 having a relatively small passage cross-sectional area are referred to as first small communication passages 56, 57.

A space above the head exists on the cylinder head 12. The space above the head is a space that makes contact with the upper surface 121 of the cylinder head 12.

The first large communication passage 55 is disposed closer to the outer side of the cylinder head 12 (closer to left in FIG. 3) than the first small communication passages 56, 57 in the cylinder arrangement direction X. In the example shown in FIG. 3, the number of first large communication passages 55 is one, and the number of first small communication passages 56, 57 is two. Furthermore, the first small communication passages 56, 57 are arranged between the exhaust passages 21 adjacent to each other in the cylinder arrangement direction X. On the other hand, the first large communication passage 55 is disposed closer to the outer side of the cylinder head 12 (closer to left in FIG. 3) than all the exhaust passages 21 in the cylinder arrangement direction X.

The cylinder head 12 is provided with a second communication passage 65 opened in the upper surface 121 of the cylinder head 12 and connected to the second oil chamber 60. The second communication passage 65 is disposed on the opposite side of the first small communication passages 56, 57 from the first large communication passage 55 in the cylinder arrangement direction X. That is, the second communication passage 65 is disposed closer to the outer side of the cylinder block 11 (closer to right in FIG. 3) than the first small communication passages 56 and 57 in the cylinder arrangement direction X.

In the present embodiment, only one second communication passage 65 is provided. The passage cross-sectional area of the second communication passage 65 is larger than the passage cross-sectional area of each of the first small communication passages 56, 57 and is substantially the same as the passage cross-sectional area of the first large communication passage 55. Therefore, the total passage cross-sectional area of the first communication passages 55 to 57 connected to the first oil chamber 50 is larger than the passage cross-sectional area of the second communication passage 65 connected to the second oil chamber 60. Thus, the resistance generated when the fluid flows between the first oil chamber 50 and the space above the head through the first communication passages 55 to 57 is smaller than the resistance generated when the fluid flows between the second oil chamber 60 and the space above the head through the second communication passage 65. The second communication passage 65 is located at a position on the opposite side of the center of the second oil chamber 60 from the partition wall 43 in the cylinder arrangement direction X and closer to the outer side (closer to right in FIG. 3) of the cylinder head 12 than all the exhaust passages 21 in the cylinder arrangement direction X.

The first large communication passage 55 includes a first large opening 55*a* opened in the upper surface 121 of the cylinder head 12. The first small communication passages 56, 57 include first small openings 56*a*, 57*a* opened in the upper surface 121 of the cylinder head 12. The second communication passage 65 includes a second opening 65*a* opened in the upper surface 121 of the cylinder head 12. As shown in FIG. 3, the upper surface 121 is formed so that each of the first small openings 56*a*, 57*a* is located above the first large opening 55*a* and the second opening 65*a*.

As shown in FIGS. 3 and 4, the upper surface 121 is provided with a first extending wall 58 extending in a direction intersecting the cylinder arrangement direction X between the first large opening 55*a* and the first small opening 56*a*. The first extending wall 58 is arranged closer to the first small opening 56*a* than the middle between the first small opening 56*a* and the first large opening 55*a* in the cylinder arrangement direction X. More specifically, the first extending wall 58 is adjacent to the peripheral edge of the first small opening 56*a*. As shown in FIG. 3, the upper surface 121 includes a first flow-down surface 59 inclined downward toward the first large opening 55*a* in the cylinder arrangement direction X between the first large opening 55*a* and the first extending wall 58.

Furthermore, as shown in FIGS. 3 and 4, the upper surface 121 is provided with a second extending wall 68 extending in a direction intersecting the cylinder arrangement direction X between the first small opening 57*a* and the second opening 65*a*. The second extending wall 68 is arranged closer to the first small opening 57*a* than the middle between the first small opening 57*a* and the second opening 65*a* in the cylinder arrangement direction X. More specifically, the second extending wall 68 is adjacent to the peripheral edge of the first small opening 57*a*. As shown in FIG. 3, the upper surface 121 includes a second flow-down surface 69 inclined downward toward the second opening 65*a* in the cylinder arrangement direction X between the second opening 65*a* and the second extending wall 68.

As shown in FIG. 3, in the cylinder head 12, the head-side cooling water passage 32 passes both immediately below the first flow-down surface 59 and immediately below the second flow-down surface 69. That is, the first flow-down surface 59 and the second flow-down surface 69 are arranged immediately above the head-side cooling water passage 32.

Figure 5:
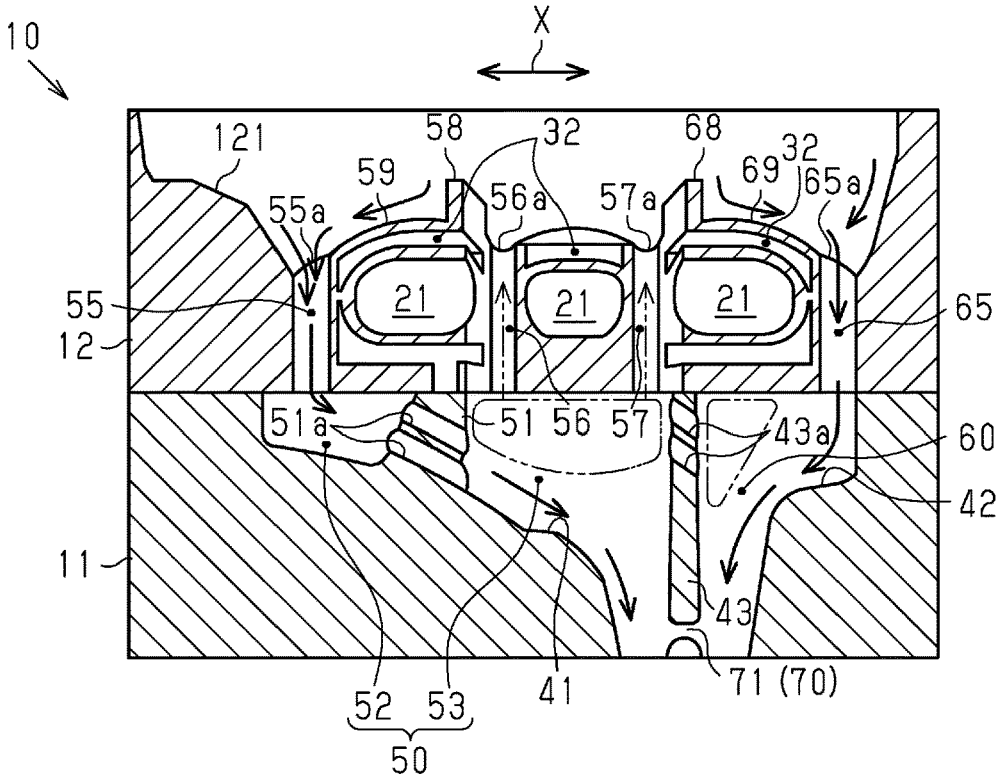
FIG. 5 is an operational view showing a state in which oil and gas flow in the internal combustion engine of FIG. 1.

Next, operations and advantages of the present embodiment will be described with reference to FIG. 5.

On the upper surface 121 of the cylinder head 12, the first large opening 55*a* and the second opening 65*a* are located below the first small openings 56*a*, 57*a*. The first extending wall 58 is disposed between the first large opening 55*a* and the first small opening 56*a*, and the second extending wall 68 is disposed between the second opening 65*a* and the first small opening 57*a*. Thus, the oil flows toward the first large opening 55*a* or the second opening 65*a* on the upper surface 121. In other words, the oil is less likely to flow toward the first small openings 56*a*, 57*a* on the upper surface 121, and the oil in the space above the head is less likely to flow into the first small communication passages 56, 57.

Furthermore, even if the amount of oil accumulated in the vicinity of the first large opening 55*a* in the space above the head becomes large, the oil is regulated from flowing into the first small communication passage 56 by the first extending wall 58. Similarly, even if the amount of oil accumulated in the vicinity of the second opening 65*a* in the space above the head becomes large, the oil is restricted from flowing into the first small communication passage 57 by the second extending wall 68. With regards to such a point, the oil in the space above the head is less likely to flow into the first small communication passages 56, 57.

Some of the oil flowing toward the first large opening 55*a* along the upper surface 121 flows on the first flow-down surface 59. Some of the oil flowing toward the second opening 65*a* along the upper surface 121 flows on the second flow-down surface 69. Since the respective flow-down surfaces 59, 69 are disposed immediately above the head-side cooling water passage 32, the oil flowing on the respective flow-down surfaces 59, 69 can be cooled by the cooling water flowing through the head-side cooling water passage 32. The oil that has reached the first large opening 55*a* flows into the first oil division chamber 52 through the first large communication passage 55 as indicated by a solid arrow in FIG. 5. After the oil in the first oil division chamber 52 flows into the second oil division chamber 53 through the through-hole 51*a*, the oil is returned to the oil pan 14 through the oil passage 70. Furthermore, the oil that has reached the second opening 65*a* along the upper surface 121 flows into the second oil chamber 60 through the second communication passage 65 as indicated by a solid arrow in FIG. 5. Then, the oil in the second oil chamber 60 is returned to the oil pan 14 through the oil passage 70.

When the engine rotation speed or the engine load factor increases, the amount of oil flowing into the space above the head increases, and hence a larger amount of oil flows toward the first oil chamber 50 from the space above the head through the first large communication passage 55. Moreover, a larger amount of oil flows toward the second oil chamber 60 from the space above the head through the second communication passage 65. Furthermore, when the engine rotation speed or the engine load factor increases, the pressure in the crankcase 13 and the oil pan 14 increases. Therefore, the blow-by gas in the crankcase 13 flows backward through the oil passage 70 and flows into the first oil chamber 50 and the second oil chamber 60. As a result, the pressure in the first oil chamber 50 and the pressure in the second oil chamber 60 increase.

The first oil chamber 50 is partitioned into the first oil division chamber 52 and the second oil division chamber 53 by the partition wall 51. The oil passage 70 is connected to the second oil division chamber 53, but is not connected to the first oil division chamber 52. Therefore, the inflow of gas such as blow-by gas accumulated in the second oil division chamber 53 to the first oil division chamber 52 is restricted by the partition wall 51. Thus, the flow of the oil from the space above the head to the first oil division chamber 52 through the first large communication passage 55 will not be inhibited by the gas accumulated in the first oil chamber 50. In FIG. 5, a region where gas is accumulated in the second oil division chamber 53 and the second oil chamber 60 is indicated by a chain double-dashed line.

In the second oil division chamber 53, gas is accumulated in the upper region thereof. That is, the gas is accumulated in the vicinity of the connecting portion with the first small communication passages 56, 57 in the second oil division chamber 53. As described above, the oil barely flows into the first small communication passages 56, 57 from the space above the head, as described above. Thus, the gas accumulated in the second oil division chamber 53 can be discharged to the outside of the first oil chamber 50 through the first small communication passages 56, 57.

Therefore, even if a large amount of oil flows into the first oil chamber 50 through the first large communication passage 55 or a large amount of blow-by gas flows into the first oil chamber 50 through the oil passage 70, the increase in the pressure of the first oil chamber 50 is limited since the gas accumulated in the second oil division chamber 53 is discharged to the outside of the first oil chamber 50 through the first small communication passages 56, 57. As a result, the circulation of oil through the first large communication passage 55 and the first oil chamber 50 can be properly carried out. The content of air bubbles can be lowered in the oil returned from the second oil division chamber 53 into the oil pan 14 through the oil passage 70 by reducing the amount of gas accumulated in the second oil division chamber 53.

On the other hand, only one communication passage connecting the second oil chamber 60 and the space above the head, that is, the second communication passage 65 is provided. That is, the resistance generated when causing gas to flow from the second oil chamber 60 to the space above the head through the second communication passage 65 is larger than the resistance generated when causing gas to flow from the first oil chamber 50 to the space above the head through the first communication passages 55 to 57. Thus, when a large amount of blow-by gas flows from the oil pan 14 to the second oil chamber 60 through the oil passage 70, the flow of oil from the space above the head to the second oil chamber 60 through the second communication passage 65 may be inhibited by the gas accumulated in the second oil chamber 60.

In this regard, in the present embodiment, the second oil chamber 60 communicates with the second oil division chamber 53 through the connection hole 43*a* provided in the partition wall 43. Therefore, even if the discharge performance of the gas from the second oil chamber 60 to the space above the head through the second communication passage 65 is low, the gas accumulated in the second oil chamber 60 can be flowed out to the second oil division chamber 53 through the connection hole 43*a*. The gas that has flowed into the second oil division chamber 53 is discharged into the space above the head through the first small communication passages 56, 57. Thus, the gas is not continuously accumulated in the second oil chamber GO. As a result, the flow of oil from the space above the head to the second oil chamber 60 through the second communication passage 65 is not inhibited by the gas accumulated in the second oil chamber 60. Therefore, the oil that has flowed into the second oil chamber 60 through the second communication passage 65 can be properly returned to the oil pan 14 through the oil passage 70. The content of air bubbles can be lowered in the oil returned from the second oil chamber 60 to the oil pan 14 through the oil passage 70 by reducing the amount of gas accumulated in the second oil chamber 60.

Gas tends to easily accumulate in the upper region of the second oil chamber 60. In this regard, in the present embodiment, the connection hole 43*a* is disposed at a portion of the partition wall 43 above the center in the vertical direction. Therefore, the gas accumulated in the second oil chamber 60 can easily flow out to the second oil division chamber 53 through the connection hole 43*a*.

Furthermore, since the gas that has flowed into the second oil chamber 60 flows out to the second oil division chamber 53 through the connection hole 43*a*, the gas easily accumulates near the partition wall 43 in the second oil chamber 60. In this regard, in the present embodiment, the second oil chamber 60 is connected to the second communication passage 65 on the opposite side of the center of the second oil chamber 60 from the partition wall 43 in the cylinder arrangement direction X. Therefore, even if the gas is accumulated in the second oil chamber 60, the flow of oil from the space above the head to the second oil chamber 60 through the second communication passage 65 is less likely to be inhibited. Furthermore, the gas accumulated in the second oil chamber 60 is easily pushed out to the second oil division chamber 53 through the connection hole 43*a* by the force of the oil flowing into the second oil chamber 60 through the second communication passage 65.

The present embodiment further has the following advantages.

(1) The first oil chamber 50 and the second oil chamber 60 are respectively disposed near the block side cooling water passage 31. The connecting portion of the oil passage 70 with respect to the first oil chamber 50 is separated from the connecting portion of the first large communication passage 55 with respect to the first oil chamber 50 in the cylinder arrangement direction X. Therefore, the time in which the oil that has flowed into the first oil chamber 50 through the first large communication passage 55 is accumulated in the first oil chamber 50 is longer as compared with the case where the connecting portion of the first large communication passage 55 with respect to the first oil chamber 50 is disposed near the connecting portion of the oil passage 70 with respect to the first oil chamber 50. As a result, the oil can be cooled by the cooling water flowing through the block side cooling water passage 31 in the course of the oil flowing toward the oil passage 70 in the first oil chamber 50. Therefore, the oil at a relatively low temperature can be returned to the oil pan 14.

(2) The passage cross-sectional area of each of the first large communication passage 55 and the second communication passage 65 is wider than the passage cross-sectional area of each of the first small communication passages 56, 57. Thus, the oil in the space above the head is easily returned to the oil pan 14 through each of the first large communication passage 55 and the second communication passage 65 as compared with the case where the passage cross-sectional area of each of the first large communication passage 55 and the second communication passage 65 is substantially equal to the passage cross-sectional area of each of the first small communication passages 56, 57.

(3) The vehicle may accelerate in the cylinder arrangement direction X depending on the traveling mode of the vehicle on which the internal combustion engine 10 of the present embodiment is mounted. In this case, in the space above the head, the oil tends to easily accumulate on the outer side than the center in the cylinder arrangement direction X due to the inertia force of the oil in the cylinder arrangement direction X. In this regard, in the present embodiment, the first large communication passage 55 and the second communication passage 65 are disposed on the outer side than the first small communication passages 56, 57 in the cylinder arrangement direction X in the cylinder block 11. Therefore, even in the case where the acceleration in the cylinder arrangement direction X acts on the internal combustion engine 10, a state where the oil accumulated in the space above the head is easily flowed into the oil chambers 50, 60 through either one of the first large communication passage 55 and the second communication passage 65 can be maintained, and state where the gas accumulated in the second oil division chamber 53 is easily discharged to the outside of the oil chamber through the first small communication passages 56, 57 can be maintained.

(4) At the portion between the two exhaust passages 21 adjacent to each other in the cylinder arrangement direction X of the cylinder head 12, the temperature tends to increase due to the heat from the exhaust gas flowing through both exhaust passages 21. In this respect, in the present embodiment, the temperature rise of the oil flowing toward the first oil division chamber 52 through the first large communication passage 55 is suppressed because the first large communication passage 55 is not disposed between the two exhaust passages 21 adjacent to each other in the cylinder arrangement direction X. The enlargement of the internal combustion engine 10 in the cylinder arrangement direction X is suppressed because the first small communication passages 56, 57 are not arranged on the outer side of the cylinder head 12 than the first large communication passage 55 in the cylinder arrangement direction X.

The above-described embodiment may be modified as follows. The above-described embodiment and the following modifications can be combined as long as the combined modifications remain technically consistent with each other.

In the embodiment described above, the first flow-down surface 59 is formed so as to be inclined downward toward the first large opening 55*a* in the cylinder arrangement direction X. However, as long as the first flow-down surface 59 is formed so as to be located more downward as it approaches the first large opening 55*a* in the cylinder arrangement direction X, the first flow-down surface 59 may have a shape different from the shape described in the embodiment described above. For example, the first flow-down surface 59 may be formed so as to be located downward in a stepwise manner as it approaches the first large opening 55*a* in the cylinder arrangement direction X.

In the embodiment described above, the second flow-down surface 69 is formed so as to be inclined downward toward the second opening 65*a* in the cylinder arrangement direction X. However, as long as the second flow-down surface 69 is formed so as to be located more downward as it approaches the second opening 65*a* in the cylinder arrangement direction X, the second flow-down surface 69 may have a shape different from the shape described in the embodiment described above. For example, the second flow-down surface 69 may be formed so as to be located more downward in a stepwise manner as it approaches the second opening 65*a* in the cylinder arrangement direction X.

The first extending wall 58 may be disposed at an intermediate position of the first flow-down surface 59 in the cylinder arrangement direction X.

The second extending wall 68 may be disposed at an intermediate position of the second flow-down surface 69 in the cylinder arrangement direction X.

As long as the flowing amount of oil from the space above the head to the first oil chamber 50 through the first large communication passage 55 can be sufficiently ensured, the passage cross-sectional area of the first large communication passage 55 does not necessarily need to be larger than the passage cross-sectional area of each of the first small communication passages 56, 57. For example, the passage cross-sectional area of the first large communication passage 55 may be equal to the passage cross-sectional area of each of the first small communication passages 56, 57, or may be narrower than the passage cross-sectional area of each of the first small communication passages 56, 57.

As long as the flowing amount of oil from the space above the head to the second oil chamber 60 through the second communication passage 65 can be sufficiently ensured, the passage cross-sectional area of the second communication passage 65 does not necessarily need to be larger than the passage cross-sectional area of each of the first small communication passages 56, 57. For example, the passage cross-sectional area of the second communication passage 65 may be equal to the passage cross-sectional area of each of the first small communication passages 56, 57, or may be narrower than the passage cross-sectional area of each of the first small communication passages 56, 57.

As long as the connecting portion of the oil passage 70 with respect to the first oil chamber 50 is arranged closer to the connecting portion of the first small communication passages 56, 57 with respect to the first oil chamber 50 than the connecting portion of the first large communication passage 55 with respect to the first oil chamber 50, the first large communication passage 55 may be disposed on the inner side in the cylinder arrangement direction X than the first small communication passages 56, 57 in the cylinder block 11.

As long as the connecting portion of the oil passage 70 with respect to the second oil chamber 60 is arranged closer to the connecting portion of the first small communication passage 57 with respect to the first oil chamber 50 than the connecting portion of the second communication passage 65 with respect to the second oil chamber 60, the second communication passage 65 may be disposed on the inner side in the cylinder arrangement direction X than the first small communication passages 56, 57 in the cylinder block 11.

The number of first large communication passages 55 connected to the first oil division chamber 52 may be an arbitrary number of two or more (e.g., two).

The number of first small communication passages connected to the second oil division chamber 53 may be an arbitrary number of three or more (e.g., four). Furthermore, the number of first small communication passages may be one as long as the discharge efficiency of the gas accumulated in the second oil division chamber 53 to the space above the head can be sufficiently secured.

An arbitrary number (e.g., four) of three or more connection holes 43*a* may be provided in the partition wall 43. The number of connection holes 43*a* provided in the partition wall 43 may be one as long as the amount of outflow of the gas from the second oil chamber 60 to the second oil division chamber 53 can be sufficiently ensured.

As long as the gas accumulated in the second oil chamber 60 can be properly allowed to flow out to the second oil division chamber 53, the connection hole 43*a* may be disposed at an intermediate position in the vertical direction of the partition wall 43 or may be disposed at a position on the lower side than the middle in the vertical direction of the partition wall 43.

The partition wall 51 may be omitted as long as the rigidity of the cylinder block 11 can be sufficiently ensured without providing the partition wall 51. In this case, the first oil chamber 50 is not divided into two oil division chambers 52, 53.

The number of second communication passages connected to the second oil chamber 60 may be equal to the number of first communication passages connected to the first oil chamber 50 or may be larger than the number of first communication passages connected to the first oil chamber 50. Even in such a case, the resistance generated when causing the gas to flow from the first oil chamber 50 to the space above the head through the first communication passage can be made smaller than the resistance generated when causing the gas to flow from the second oil chamber 60 to the space above the head through the second communication passage by making the length of the second communication passage longer than the length of the first communication passage.

Furthermore, in the case where the passage cross-sectional area of the second communication passage is equal to the passage cross-sectional area of the first communication passage, the number of first communication passages may be made larger than that of the second communication passage. Even in such a case, the resistance generated when causing the gas to flow from the first oil chamber 50 to the space above the head through the communication passage can be made smaller than the resistance generated when causing the gas to flow from the second oil chamber 60 to the space above the head through the second communication passage.

Furthermore, in the case where the total passage cross-sectional area of the second communication passage is equal to the total passage cross-sectional area of the first communication passage, the length of first communication passage may be made shorter than that of the second communication passage. Even in this case, the resistance generated when causing the gas to flow from the first oil chamber 50 to the space above the head through the first communication passage can be made smaller than the resistance generated when causing the gas to flow from the second oil chamber 60 to the space above the head through the second communication passage.

As long as the number of cylinders 15 provided in the cylinder block 11 is an odd number of three or more, the number of cylinders 15 may be an arbitrary number (e.g., five) other than three.

The number of cylinders 15 provided in the cylinder block 11 may be an even number (e.g., four). In this case, the volume of the first oil chamber 50 does not necessarily need to be larger than the volume of the second oil chamber 60. For example, the volume of the first oil chamber 50 may be equal to the volume of the second oil chamber 60, or may be smaller than the volume of the second oil chamber 60.

The invention claimed is:

1. An internal combustion engine comprising:

a cylinder block including a plurality of cylinders arranged in a cylinder arrangement direction, a first recess and a second recess arranged in the cylinder arrangement direction, and a partition wall located between the first and second recesses; and a cylinder head attached to the cylinder block, the cylinder head closing the first recess and the second recess to form a first oil chamber and a second oil chamber arranged in the cylinder arrangement direction with the partition wall interposed in between in the cylinder block, wherein the cylinder head includes a first communication passage opened in an upper surface of the cylinder head and connected to the first oil chamber, and a second communication passage opened in the upper surface of the cylinder head and connected to the second oil chamber, a space above a head existing above the cylinder head, the first and second communication passages are configured so that a resistance generated when gas is caused to flow from the first oil chamber to the space above the head through the first communication passage is smaller than a resistance generated when gas is caused to flow from the second oil chamber to the space above the head through the second communication passage, the cylinder block includes an oil passage connected to both the first oil chamber and the second oil chamber and configured to return oil accumulated in the oil chambers to an oil pan, and the partition wall includes a connection hole allowing the first oil chamber and the second oil chamber to communicate with each other.

2. The internal combustion engine according to claim 1, wherein the first communication passage comprises a plurality of first communication passages, and the second communication passage comprises one or more second communication passages, and wherein a number of the first communication passages is larger than a number of the second communication passages.

3. The internal combustion engine according to claim 1, wherein the connection hole is arranged at a portion above the middle in a vertical direction of the partition wall.

4. The internal combustion engine according to claim 1, wherein the connection hole is one of a plurality of connection holes arranged in the vertical direction.

5. The internal combustion engine according to claim 1, wherein the second communication passage is connected to the second oil chamber on an opposite side of a center of the second oil chamber from the partition wall in the cylinder arrangement direction.

6. The internal combustion engine according to claim 1, wherein the connection hole is extended in a direction inclined with respect to the cylinder arrangement direction.

7. The internal combustion engine according to claim 1, wherein a volume of the second oil chamber is smaller than a volume of the first oil chamber.

8. The internal combustion engine according to claim 1, wherein a number of cylinders is an odd number of three or more, and the partition wall is arranged between center axes of two of the cylinders adjacent to each other in the cylinder arrangement direction.

* * * * *